US006076213A

United States Patent [19]

Chase, Jr.

[11] Patent Number: 6,076,213

[45] Date of Patent: Jun. 20, 2000

[54] PORTABLE INFLATABLE MASSAGE SUPPORT APPARATUS

[76] Inventor: Carl A. Chase, Jr., 51250 Partington Ridge, Big Sur, Calif. 93920

[21] Appl. No.: 08/909,712

[22] Filed: Aug. 11, 1997

[51] Int. Cl.[7] ..... A47C 27/08

[52] U.S. Cl. ..... 5/706; 5/632; 5/655.3

[58] Field of Search ..... 5/706, 710, 632, 5/648, 655.3, 638, 644, 620, 708, 711, 712

[56] References Cited

U.S. PATENT DOCUMENTS

| | | | |
|---|---|---|---|
| D. 220,953 | 6/1971 | Des Pres | 5/655.3 X |
| D. 311,470 | 10/1990 | Cosgrove, III et al. | 5/648 X |
| D. 345,797 | 4/1994 | Gardner | 5/648 X |
| 1,830,570 | 11/1931 | Smith et al. | 5/655.3 X |
| 2,688,142 | 9/1954 | Jensen | 5/644 X |
| 2,819,712 | 1/1958 | Morrison | 5/655.3 X |
| 2,919,747 | 1/1960 | Post | 5/655.3 X |
| 3,068,494 | 12/1962 | Pinkwater | 5/702 |
| 3,133,696 | 5/1964 | Mirando | 5/708 X |
| 3,253,861 | 5/1966 | Howard | 5/655.3 X |
| 3,283,343 | 11/1966 | Worcester | 5/644 |
| 3,312,987 | 4/1967 | Emery | 5/644 |
| 3,416,169 | 12/1968 | Emery | 5/644 |
| 3,736,027 | 5/1973 | Stafford | 5/655.3 X |
| 5,125,123 | 6/1992 | Engle | 5/648 |
| 5,289,828 | 3/1994 | Toth | 5/648 X |
| 5,479,667 | 1/1996 | Nelson et al. | 5/632 X |
| 5,611,772 | 3/1997 | Fujimoto et al. | 601/149 |
| 5,890,246 | 4/1999 | Davis | 5/706 X |
| 5,893,183 | 4/1999 | Bechtold, Jr. | 5/632 |

FOREIGN PATENT DOCUMENTS

| | | | |
|---|---|---|---|
| 195057 | 1/1958 | Austria | 5/632 |
| 602056 | 7/1978 | Switzerland | 5/648 |

*Primary Examiner*—Terry Lee Melius
*Assistant Examiner*—Robert G. Santos

[57] ABSTRACT

A portable, inflatable, massage support apparatus. In one embodiment, the present invention is comprised of an inflatable body supporting structure having a top surface and a bottom surface. The top surface and the bottom surface define an enclosure therebetween when the inflatable body supporting structure is inflated. In the present invention, the inflatable body supporting structure has a head end and a foot end. Additionally, in the present invention, the inflatable body supporting structure has massage facilitating features formed into the inflatable body supporting structure. The massage facilitating features are adapted to enhance the massaging of a person when the person is disposed on the inflatable body supporting structure.

1 Claim, 3 Drawing Sheets

PORTABLE INFLATABLE MASSAGE SUPPORT APPARATUS

This application is a Continued Prosecution of U.S. patent application entitled, Ser. No. 08/909,712 Filed Aug. 11, 1997.

TECHNICAL FIELD

The present claimed invention relates to the field of massage therapy. More specifically, the present claimed invention relates to supporting structures used during a massage.

BACKGROUND ART

Massage is widely practiced and accepted as a relaxing and therapeutic treatment for various conditions. During a typical massage, the client (i.e. the person being massaged) lies on a massage table. The client's face is typically supported in a face cradle extending from the head-end of the massage table. Additionally, often a cylindrical foot bolster is placed under the client's ankles (near the foot-end of the massage table) to provide further support for the client's body during the massage. The massage table is commonly a substantial, solid, table-like structure having a padded top surface. Such prior art massage tables also require adaptations/mechanical contraptions to accommodate the attachment of a face cradle thereto. Conventional massage tables are extremely heavy (weighing as much as or more than 50 pounds), are extremely bulky (about the size of a twin bed), and are often very expensive (typically costing in the range of 600–800 dollars). Hence, conventional massage tables are inherently un-portable, and are not affordable for many people.

As yet another drawback, a conventional massage table, and its accompanying face cradle and foot bolster, does not always provide appropriate support for the client during the massage. For example, after much use, the foam-pad filling of a conventional face cradle often shifts or becomes dislodged within the face cradle. As a result, the face cradle exerts undue stress on the forehead and/or cheekbones of the client. Also, if the face cradle is disposed too near the head-end of the massage table, the throat/Adam's apple area of the client may be subjected to excess pressure from the head-end of the massage table. In such an instance, the client's breathing and comfort is compromised. Similarly, a conventional massage table may have the foam-pad filling thereof shifted or dislodged from the desired locations. Hence, bony protuberances present at, for example, the client's hips and/or shoulders may have unwanted and deleterious pressure exerted thereon.

As still another drawback, during some types of massage therapy, it is desired to rotate or "rock" the client's body during the massage. The unyielding(restrictive and static nature of prior art massage tables, face cradles, and foot bolsters is not always well suited to such dynamic massage techniques.

Thus, a need exists for a massage support structure which is lightweight, compact, and inexpensive. A further need exists for a massage support structure which is readily portable. Still another need exists for a massage support structure which meets the above needs and which provides appropriate and comfortable massage support without unduly restricting movement of the client's body.

DISCLOSURE OF THE INVENTION

The present invention provides a massage support structure which is lightweight, compact, and inexpensive. The present invention further provides a massage support structure which is readily portable. The present invention also meets the above needs and further achieves a massage support structure which provides appropriate and comfortable massage support without unduly restricting movement of the client's body. The present invention meets the above needs with a portable, inflatable, massage support structure.

More specifically, in one embodiment, the present invention is comprised of an inflatable body supporting structure having a top surface and a bottom surface. The top surface and the bottom surface define an enclosure therebetween when the inflatable body supporting structure is inflated. In the present invention, the inflatable body supporting structure has a head end and a foot end. Additionally, in the present invention, the inflatable body supporting structure has massage facilitating features formed into the inflatable body supporting structure. The massage facilitating features are adapted to enhance the massaging of a person when the person is disposed on the inflatable body supporting structure.

In another embodiment, the present invention includes the features of the above-described embodiment and further includes an inflatable foot bolster for supporting the feet of a person being massaged.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
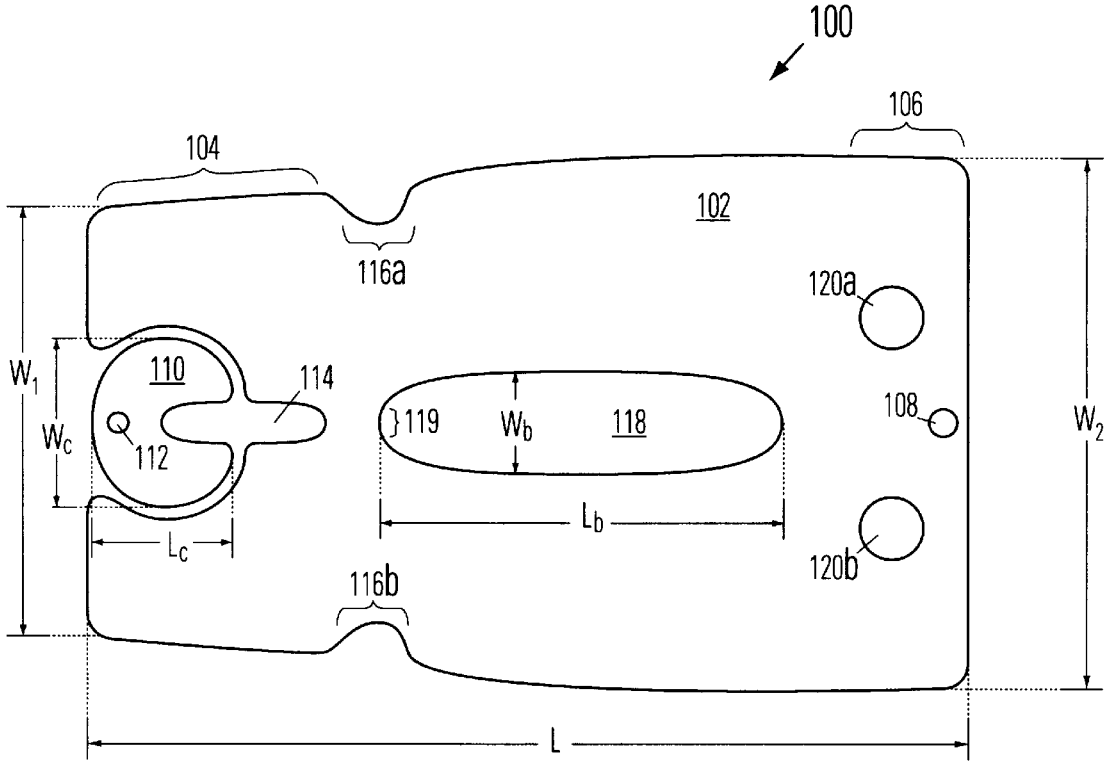
FIG. 1 is a top view of the present portable inflatable massage support apparatus showing massage facilitating features in accordance with the present claimed invention.

With reference now to FIG. 1, a top view of the present portable inflatable massage support apparatus with massage facilitating features in accordance with the present invention is shown. In one embodiment, the present invention is comprised of an inflatable body supporting structure 100 having a top surface 102 and a bottom surface (hidden). Top surface 102 and the bottom surface, hidden, define an enclosure therebetween when inflatable body supporting structure 100 is inflated. When inflated, inflatable body supporting structure 100 forms a "body pillow" which is adapted to comfortably support the body of a person during a massage. In the present embodiment, top surface 102 and the bottom surface, hidden, are sealed at together at their respective edges using, for example, a heat sealed flange. Inflatable body supporting structure 100 further includes a head end 104 and a foot end 106. An inflation valve 108 is disposed on inflatable body supporting structure 100 near foot end 106 thereof. Inflation valve 108 is coupled to inflatable body supporting structure 100 and extends through inflatable body supporting structure 100 to provide for inflation thereof. Although inflation valve 108 is disposed as shown in the present embodiment, the present invention is also well suited to having inflation valve 108 located elsewhere on inflatable body supporting structure 100. Additionally, inflatable body supporting structure 100 is adapted to be inflated either orally, or with an air pump.

Referring still to FIG. 1, in the present embodiment, inflatable body supporting structure 100 has a length, L, of approximately 49 inches, a width, $w_1$, at head end 104 of approximately 24 inches, and a width, $w_2$, at foot end 106 of approximately 29 and ½ inches. When inflated, inflatable body supporting structure has a height of approximately 12 and ¼ inches. The present invention is, however, well suited to increasing or decreasing the dimensions of inflatable body supporting structure 100 as desired. In the present embodiment, inflatable body supporting structure 100 is formed of 20–30 mil thick vinyl. Although such a material is used in the present embodiment, the present invention is well suited to being formed of any other various other materials such as plastics, rubber, and the like. Also, by forming inflatable body supporting structure 100 of light-weight foldable material (e.g. 20–30 mil vinyl), the present invention can be compactly folded and easily carried when deflated. In fact, in the present embodiment, inflatable body supporting structure 100 weighs only 3–5 pounds, and, when deflated can easily fit within a small (e.g. grocery bag-sized) carrying bag. Furthermore, the present invention can be inexpensively manufactured compared to conventional massage tables. Thus, unlike conventional massage tables, the present invention is extremely light (weighing as little or even less than 3 pounds), is extremely compact (when deflated, about the size of a telephone book), and is very inexpensive (costing much less than the 600–800 dollars charged for conventional massage tables). The inflatable body supporting structure 100 of the present invention is well suited to being placed, for example, on the floor, on a table, on a bed, or other firm surface. During use, a sheet or other object can be placed over the present invention to provide a more comfortable surface, and to prevent massage oils and the like from contacting the present invention. Thus, the present invention provides a portable, compact massaging surface, and eliminates the need for a conventional, bulky, heavy, and expensive massage table.

In the embodiment of FIG. 1, inflatable body supporting structure 100 includes an interior face cradle 110 disposed proximate to head end 104 of inflatable body supporting structure 100. Interior face cradle 110 supports the head/face of a person during a massage. In the present embodiment, interior face cradle 110 is disposed between top surface 102 and bottom surface, hidden, of inflatable body supporting structure 100. That is, interior face cradle 110 is disposed within the enclosure defined by top surface 102 and the bottom surface, hidden, of inflatable body supporting structure 100. Thus, in the present embodiment, interior face cradle 110 is integral with inflatable body supporting structure 100. Interior face cradle 110 has a size sufficient to comfortably support the forehead and cheeks of a person being massaged. For example, in the present embodiment, interior face cradle 110 has a total length, $L_c$, of approximately 8 and ½ inches, and a total width, $w_c$, of approximately 10 inches. Furthermore, in the present embodiment, interior face cradle 110 is inflatable. In the present inflatable embodiment, inflatable interior face cradle 110 includes an inflation valve 112. Inflation valve 112 is coupled to interior face cradle 110 and extends through the bottom surface, hidden, of inflatable body supporting structure 100 to provide for inflation of said interior face cradle. Although inflation valve 112 is disposed as shown in the present embodiment, the present invention is also well suited to having inflation valve 112 located elsewhere on inflatable interior face cradle 110. Additionally, although interior face cradle 110 is inflatable in the present embodiment, the present invention is also well suited to having a non-inflatable interior face cradle disposed between top surface 102 and the bottom surface, hidden, of inflatable body supporting structure 100.

By using the inflatable face cradle of the present embodiment, the present invention comfortably supports the face/head of the person being massaged. That is, unlike conventional face cradles, the present invention does not contain conventional foam pad filling which often shifts or becomes dislodged within a conventional face cradle. Hence, the inflatable interior face cradle 110, of the present embodiment, does not exert undue stress on the forehead and/or cheekbones of the client (i.e. the person being massaged).

The present invention is also well suited to not having a face cradle disposed within the enclosure defined by top surface 102 and the bottom surface, hidden, of inflatable body supporting structure 100. In such an embodiment, during a massage, a cradle-less inflatable body supporting structure would be utilized in conjunction with a face cradle which is disposed separate from the cradle-less inflatable body supporting structure.

With reference again to the embodiment of FIG. 1, inflatable body supporting structure 100 also includes a faceplate opening 114. Faceplate opening 114 of the present embodiment is disposed near head end 104 of inflatable body supporting structure 100 within the recessed portion of interior face cradle 110. In this embodiment, faceplate opening 114 extends completely through inflatable body supporting structure 100 such that when a person is disposed face down on top surface 102 of inflatable body supporting structure 100, the person is able to breathe. Additionally, the soft, air-filled characteristics of inflatable body supporting structure 100 insures that the client's neck and throat area are comfortably supported. That is, unlike prior art massage tables and face cradles, the present invention does not subject the client's throat/Adam's apple to excess pressure from the head-end of the massage table. Hence, by using the present invention, the client's breathing and comfort is not compromised.

Referring still to FIG. 1, the present inflatable body supporting structure 100, and the above-described massage facilitating features enhance the massaging of a client disposed on inflatable body supporting structure 100. That is, due to the soft, air-filled nature of the present invention, rocking or other dynamic massage motions are comfortable and easily realized. That is, unlike the prior art, bony protuberances present at, for example, the client's hips and/or shoulders will not have unwanted and deleterious pressure exerted thereon. Furthermore, because of the compressible nature of the present invention, inflatable body supporting structure 100 conforms to the unique contour and shape of each client. Thus, clients of varying proportions and sizes can all be comfortably supported using an identical inflatable body supporting structure 100.

Figure 2:
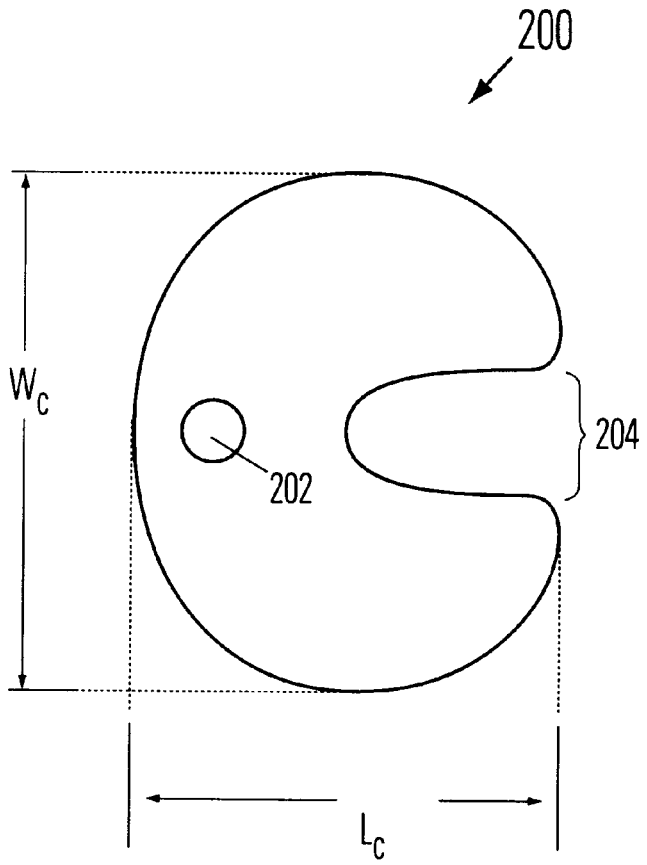
FIG. 2 is a top view of an inflatable face cradle having an inflation valve in accordance with the present claimed invention.

With reference next to FIG. 2, a top view of an inflatable face cradle 200 having an inflation valve 202 in accordance with the present invention is shown. In the present embodiment, inflatable face cradle 200 does not reside within inflatable body supporting structure 100 of FIG. 1. Instead, inflatable face cradle is well suited to being utilized in conjunction with a conventional massage table, a cradleless inflatable body supporting structure, or other massage support device. As described above, inflatable face cradle 200 is formed of 20–30 mil thick vinyl. Although such a material is used in the present embodiment, the present invention is well suited to being formed of any other various other materials such as plastics, rubber, and the like. Also, inflatable face cradle 200 has a size sufficient to comfortably support the forehead and cheeks of a person being massaged. For example, in the present embodiment, inflatable face cradle 200 has a total length, $L_c$, of approximately 8 and ½ inches, and a total width, $w_c$, of approximately 10 inches. When deflated, inflatable face cradle 200 is compact enough to fit within someone's pocket. Thus, inflatable face cradle 200 of the present embodiment is capable of being made (i.e. through deflation) extremely compact and portable.

With reference still to FIG. 2, the present inflatable face cradle also includes a recessed region 204. Recessed region 204 is adapted to receive the client's throat/neck area. Thus, inflatable face cradle 200 does not subject the client's throat/Adam's apple to excess pressure from the head-end of the massage table. Hence, by using the present invention, the client's breathing and comfort is not compromised.

With reference again to FIG. 1, the present inflatable body supporting structure also includes arm cradling portions 116*a* and 116*b* formed therein. In the present embodiment, arm cradling portions 116*a* and 116*b* are comprised of depressions which readily accept the arms of the client. Thus, arm cradling portions 116*a* and 116*b* allow the client's arms to comfortably extend away from inflatable body supporting structure 100.

The present embodiment also includes an interior body bolster 118. Interior body bolster 118 provides additional support for the client's midsection when the client lies on the present inflatable body support structure. In the present embodiment, interior body bolster 118 is disposed between top surface 102 and bottom surface, hidden, of inflatable body supporting structure 100. That is, interior body bolster 118 is disposed within the enclosure defined by top surface 102 and the bottom surface, hidden, of inflatable body supporting structure 100. Thus, in the present embodiment, interior body bolster is integral with inflatable body supporting structure 100. Interior body bolster 118 has a size sufficient to comfortably support the torso of the client. For example, in the present embodiment, interior body bolster 118 has a total length, $L_b$, of approximately 22 inches, and a total width, $w_b$, of approximately 5 and ½ inches.

In the present embodiment, interior body bolster 118 is inflatable. More specifically, as inflatable body supporting structure 100 is inflated, air is forced into interior body bolster 118. As interior body bolster 118 becomes inflated, opening 119 closes. In so doing, interior body bolster 118 is completely inflated and maintains its inflated state regardless of the pressure or degree to which inflatable body supporting structure 100 is inflated. Thus, once inflated, interior body bolster 118 provides additional support for the torso of the client lying on inflatable body support 100. Additionally, interior body bolster 118 is sensitive to the pressure exerted thereon by the client. In fact, interior body bolster 118 is able to release pressure therefrom when the client applies excessive force. That is, if a heavier client lies on inflatable body support 100 and, consequently, interior body bolster 118, air may be forced from interior body bolster 118 via opening 119 until the pressure applied to the client's torso is reduced. In so doing, interior body bolster 118 regulates the pressure or support applied to the client's torso. It will be understood that the amount of pressure or support applied to the client's body is regulated by varying the parameters of opening 119 to control the amount of pressure required to expel air from inflated interior body bolster 118. Furthermore, although such a pressure sensitive air valve is used in the present embodiment, the present invention is also well suited to using various other means such as, for example, a conventional inflation valve, to inflate and/or control the support or pressure applied by interior body bolster 118.

Referring still to FIG. 1, the present embodiment also includes knee support regions 120*a* and 120*b* formed into inflatable body supporting structure 100. Knee support regions 120*a* and 120*b* are disposed proximate to foot end 106 of inflatable body supporting structure 100, and are adapted to comfortably support the knees of a client during a massage. In the present embodiment, knee support regions 120*a* and 120*b* are comprised of depressions which readily accept the knees of the client. Although the present embodiment includes, interior face cradle 110, faceplate opening 114, arm cradling portions 116*a* and 116*b*, interior body bolster 118, and knee support regions 120*a* and 120*b*, the present invention is also well suited to an embodiment which include less than all of the aforementioned massage facilitating features.

Figure 3:
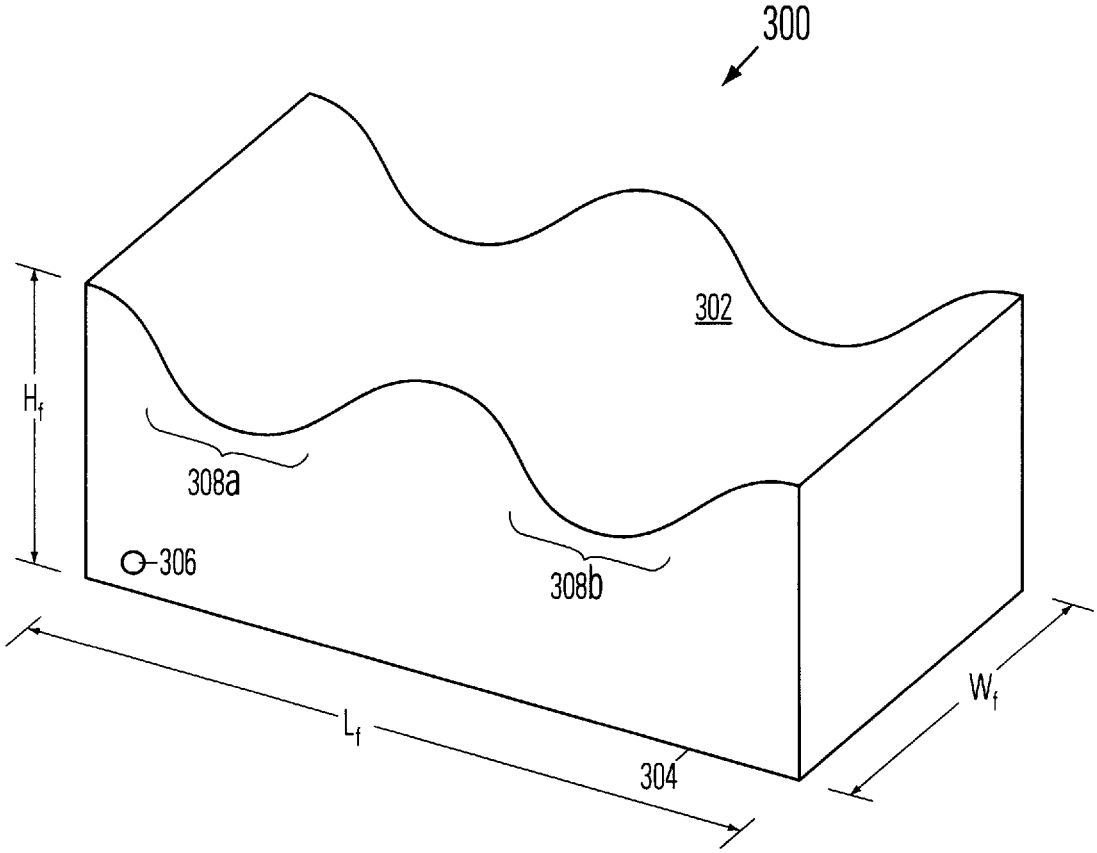
FIG. 3 is a perspective view of an inflatable foot bolster in accordance with the present claimed invention.

With reference now to FIG. 3, a perspective view of an inflatable foot bolster 300 in accordance with the present embodiment is shown. Inflatable foot bolster 300 of the present embodiment is adapted for supporting the feet of a client being massaged. Inflatable foot bolster of FIG. 3 includes a top surface 302 and a flat bottom surface 304. Top surface 302 and flat bottom surface 304 define an enclosure therebetween when inflatable foot bolster 300 is inflated. The present inflatable foot bolster 300 also includes an inflation valve 306. Inflation valve 306 is coupled to the interior of inflatable foot bolster 300 and extends through the exterior thereof to provide for inflation of inflatable foot bolster 300.

With reference still to FIG. 3, inflatable foot bolster 300 also includes a first depression 308*a* and a second depression 308*b* for receiving the feet (i.e. cradling the ankles) of a client being massaged. Additionally, by having a flat bottom surface 304, inflatable foot bolster 300 remains steady when a client is massaged. That is, unlike conventional foam pad-filled cylindrical foot bolsters, the present inflatable foot bolster 300 will not shift, roll, or substantially move during a massage.

In the present embodiment, inflatable foot bolster 300 does not reside within inflatable body supporting structure 100 of FIG. 1. Instead, inflatable foot bolster 300 is well suited to being utilized in conjunction with a conventional massage table, the above-described inflatable body supporting structure 100, or other massage support device. Inflatable foot bolster 300 is formed of 20–30 mil thick vinyl. Although such a material is used in the present embodiment, the present invention is well suited to being formed of any other various other materials such as plastics, rubber, and the like. Also, inflatable foot bolster 300 has a size sufficient to comfortably support the ankles/feet of a person being massaged. For example, in the present embodiment, inflatable foot bolster 300 has a total length, $L_f$, of approximately 23 and ½ inches, a maximum height, $H_f$, of approximately 6 and ½ inches, and a total width, $w_f$, of approximately 8 inches. When deflated, inflatable foot bolster 300 is compact enough to fit within someone's pocket. Thus, inflatable foot bolster 300 of the present embodiment is capable of being made (i.e. through deflation) extremely compact and portable.

With reference still to FIG. 3, the present inflatable foot bolster also includes recessed regions 308*a* and 308*b*. Recessed regions 308*a* and 308*b* are adapted to receive the client's ankles/feet, and allow the client's ankles/feet to swivel and move naturally during a massage. Thus, inflatable foot bolster 300 does not move or shift during a massage, but still allows the client's ankles/feet to be comfortably supported and swivel naturally during a massage.

Thus, the present invention provides a massage support structure which is lightweight, compact, and inexpensive. The present invention further provides a massage support structure which readily portable. The present invention also meets the above needs and further achieves a massage support structure which provides appropriate and comfortable massage support without unduly restricting movement of the client's body.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A massage support structure assembly comprising:

an inflatable body supporting structure having a top surface and a bottom surface, said top surface and said bottom surface defining an enclosure therebetween when said inflatable body supporting structure is inflated, said inflatable body supporting structure having a head end and a foot end;

an inflatable face cradle disposed proximate to said head end of said inflatable body supporting structure for supporting the head of said person being massaged;

a faceplate opening disposed near head end of said inflatable body supporting structure, said faceplate opening formed completely through said inflatable body supporting structure such that if said person is disposed face down on said top surface of said inflatable body supporting structure, said person is able to breathe;

an interior body bolster disposed between said head end and said foot end of said inflatable body supporting structure, said interior body bolster for supporting the torso region of said person being massaged, said interior body bolster disposed between said top surface and said bottom surface of said inflatable body supporting structure such that said interior body bolster is disposed within said enclosure of said inflatable body supporting structure:

knee support regions formed into said inflatable body supporting structure, said knee support regions disposed proximate to said foot end of said inflatable body supporting structure for comfortably supporting the knees of said person being massaged;

arm cradling portions formed into said inflatable body supporting structure, said arm cradling portions for comfortably supporting the arms of said person being massaged; and wherein said inflatable face cradle comprises:

a U-shaped structure having a first side, a second side, and a base, said first side, said second side and said base defining said faceplate opening therebetween, said first side of said U-shaped structure comprising a first cheek supporting region, said second side of said U-shaped structure comprising a second cheek supporting region, and said base of said U-shaped structure comprising a forehead supporting region, said opening of said U-shaped structure for comfortably receiving the face of said person when said person is disposed face down on said inflatable massage support structure, said U-shaped structure having a width measured from said first side of said U-shaped structure to said second side of said U-shaped structure of approximately 10 inches, said U-shaped structure having a length measured from said base of said U-shaped structure to the end of said opening of said U-shaped structure of approximately 8.5 inches.

* * * * *